US006061955A

United States Patent [19]

Domstein

[11] Patent Number: 6,061,955

[45] Date of Patent: May 16, 2000

[54] COLLAPSIBLE FLOWER VASE ASSEMBLY INCLUDING PEDESTAL BASE CORK ATTACHMENT

[76] Inventor: Randall A. Domstein, 13741 Ludlow St., Oak Park, Mich. 48237

[21] Appl. No.: 09/154,463

[22] Filed: Sep. 16, 1998

[51] Int. Cl.[7] ..... A01G 5/00; A01G 9/02; A47G 7/00; B65D 85/50; B65D 85/52

[52] U.S. Cl. ..... 47/41.01; 47/72; 47/84; 206/423

[58] Field of Search ..... 206/423, 232; 40/312; 383/33; 229/125.38; 47/41.01, 41.1, 41.12, 41.13, 41.15, 72

[56] References Cited

U.S. PATENT DOCUMENTS

| | | | |
|---|---|---|---|
| D. 363,254 | 10/1995 | McGranaghan | D11/143 |
| 786,547 | 4/1905 | Chamberlain | 26/423 |
| 930,615 | 8/1909 | Purdue | 206/423 |
| 1,044,260 | 11/1912 | Schloss | 206/423 |
| 1,270,554 | 6/1918 | Rubel | 206/423 |
| 2,064,707 | 12/1936 | Wilson | 206/423 |
| 2,160,998 | 6/1939 | Wilson | 206/423 |
| 2,176,955 | 10/1939 | Clow | 206/423 |
| 2,767,831 | 10/1956 | Brecht | 206/423 |
| 2,830,405 | 4/1958 | Nydegger | 206/423 |
| 3,127,011 | 3/1964 | Weddle | 206/423 |
| 3,324,993 | 6/1967 | Bruno | 206/423 |
| 3,924,354 | 12/1975 | Gregoire | 47/84 |
| 3,928,936 | 12/1975 | Wollen | 47/41.15 |
| 3,938,728 | 2/1976 | Deards et al. | 229/14 B |
| 3,962,826 | 6/1976 | Kienlen et al. | 47/41.13 |
| 4,043,077 | 8/1977 | Stonehocker | 47/66.1 |
| 4,204,598 | 5/1980 | Adams | 206/426 |
| 4,333,267 | 6/1982 | Witte | 47/84 |
| 4,335,769 | 6/1982 | McManus | 383/11 |
| 4,863,015 | 9/1989 | Toltzman | 206/756 |
| 4,910,913 | 3/1990 | Streeter | 47/72 |
| 4,936,046 | 6/1990 | Miller | 47/41.01 |
| 5,005,760 | 4/1991 | van den Hoogen | 229/125.38 |
| 5,038,606 | 8/1991 | Geschwender et al. | 73/171 |
| 5,060,798 | 10/1991 | Braastad | 206/423 |
| 5,088,216 | 2/1992 | Wasilko | 40/124.4 |
| 5,195,270 | 3/1993 | Domurat | 47/41.01 |
| 5,379,549 | 1/1995 | Carcich et al. | 47/84 |
| 5,403,634 | 4/1995 | Mauffette | 428/34.3 |
| 5,546,697 | 8/1996 | Lymberis et al. | 47/41.15 |
| 5,572,826 | 11/1996 | Weder | 47/41.12 |
| 5,606,845 | 3/1997 | Weder | 53/411 |
| 5,662,973 | 9/1997 | Weder | 428/36.9 |
| 5,666,763 | 9/1997 | Kao | 47/84 |
| 5,682,725 | 11/1997 | Weder | 53/412 |
| 5,687,503 | 11/1997 | D'Costa | 47/41.01 |
| 5,732,830 | 3/1998 | Harrington | 211/4 |
| 5,913,686 | 6/1999 | Van Winkle | 434/267 |

*Primary Examiner*—Michael J. Carone
*Assistant Examiner*—Frederick T. French, III
*Attorney, Agent, or Firm*—Gifford, Krass, Groh, Sprinkle, Anderson & Citkowski, P.C.

[57] ABSTRACT

A collapsible flower vase assembly for use in holding and preserving a plurality of long-stemmed flowers in an entrapped volume of water. The assembly includes an elongate and sleeve shaped body which defines a polygonal shape in cross section. Fold lines extend along a longitudinal length of the body and the body includes a first open end and second open end. A cork attachment corresponds in shape to the cross sectional shape of the sleeve body and is biasingly engaged against the second open end of the sleeve body so that the interior of the body is water tight and the attachment provides a pedestal base for the arraying the body in an upwardly extending fashion. The sleeve shaped body is further capable of being outwardly expanded from a first folded position to a second unfolded position prior to the cork attachment being releasably secured.

14 Claims, 4 Drawing Sheets

COLLAPSIBLE FLOWER VASE ASSEMBLY INCLUDING PEDESTAL BASE CORK ATTACHMENT

BACKGROUND OF THE INVENTION

1. Field of the Invention

The present invention relates generally to collapsible and disposable flower vase assemblies and, more particularly, to a collapsible flower vase assembly including a pedestal base cork attachment and an optional greeting card.

2. Description of the Prior Art

Collapsible flower vase assemblies are well known in the art, the purpose for which is to provide a convenient and inexpensive alternative to heaver glass or ceramic vases. In particular, such portable types of vase assemblies invaluable for use with floral delivery services and instances where it is difficult to locate a suitable vase for the holding of flowers which have been delivered.

U.S. Pat. No. 5,687,503, issued to D'Costa, discloses an erectable flower vase constructed from a sheet of waterproof and glued to form material having pre-creased fold lines and which are glued into a single piece with an enclosed water tight base through four base flaps. An apertured stiffening member forms a part of the blank of material and includes a circular cutout for permitting flower stems to project upwardly therethrough. The vase includes a greeting card piece which is securable to the base in the manner indicated.

While teaching a unique flower vase construction, the design of D'Costa asserts that the flaps of the base can be cut and creased and glued together so as to form a water tight and collapsible arrangement easily within the skill of those in the relevant art. The practicality of the matter however is that the ability to efficiently and effectively form a watertight base by folding and gluing the one-piece and foldable blank of D'Costa in fact is somewhat more difficult than is represented in the application.

U.S. Pat. No. 5,403,634, issued to Mauffette, discloses a collapsible flower vase including an elongate sleeve member, a pair of collars engageable with corresponding edges of the sleeve member, and a flexible and water tight bag received within the sleeve and secured between one of the collars and an edge of the sleeve member. U.S. Pat. No. 4,910,913, issued to Streeter, discloses a paper vase blank including fold lines and cuts which form a three dimensional vase with a flat triangular shaped bottom, tapered sides and an irregular sculpted upper edge. Streeter is similar in regards to D'Costa which likewise provides a one piece and foldable blank, however Streeter does not profess to create a watertight seal.

SUMMARY OF THE PRESENT INVENTION

The present invention is a novel and unique collapsible flower vase assembly for use in holding and preserving a plurality of long-stemmed flowers in an entrapped volume of water. An elongate and sleeve shaped three dimensional body defines a polygonal shape in cross section, such a polygon being defined as any number of sides from three, representing a triangular shape, to an infinite number of sides, representing a circular shape. The sleeve shaped body includes a selected number of spaced apart and parallel extending fold lines, such as two for a circular shaped sleeve body or four for a rectangular shaped sleeve body. The purpose of the fold lines is to permit the sleeve shaped body to be outwardly expanded from a first folded position to a second unfolded position such that the sleeve body may be conveniently packaged or otherwise stored prior to being used. The sleeve shaped body is further constructed of a flexible and water proof material and includes a first open end and a second open end.

A cork attachment is constructed of a plasticized material and includes a central planar shaped portion and a plurality of upwardly extending and interconnected sides which correspond substantially to the lower second open end of the sleeve and biasingly engage against inwardly facing surfaces of the sleeve to releasably secure the cork attachment to the sleeve and so that the cork attachment provides a pedestal base support for arraying the sleeve body in an upwardly extending fashion from a level surface. A plurality of outwardly angled and upwardly extending teeth extend in aligned and perimetrical fashion from the interconnected sides of the cork attachment and facilitate in engaging against the sleeve. According to a further preferred embodiment, an outwardly projecting bead portion extends in encircling fashion from the outwardly facing surfaces and around the perimeter of the cork attachment so as to define a sealing and water tight engagement between the cork attachment and the second open end of the sleeve body.

A stiffening collar portion is provided and corresponds in shape with the polygonal cross sectional shape of the selected sleeve shaped portion. The stiffening collar portion defines in cross section a substantially "U" shaped configuration which permits the collar portion to be engaged over a rim defining a top edge of the first open end of the sleeve shaped body.

A greeting card may be secured to the sleeve shaped body in some fashion and this includes forming an aperture in the sleeve shaped body at a selected location (preferably proximate to the upper end so as not to conflict with the poured height of the internally held volume of water) and then attaching a length of cord to the body through a knotted end which extends through the aperture. The greeting card may then be secured to an end of the cord opposite the knotted end. Additional proposed variants include affixing the card directly to the surface of the sleeve shaped body through the use of an adhesive or even placing a written greeting indicia upon an exterior facing surface of the sleeve shaped body by adhesive or other means.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
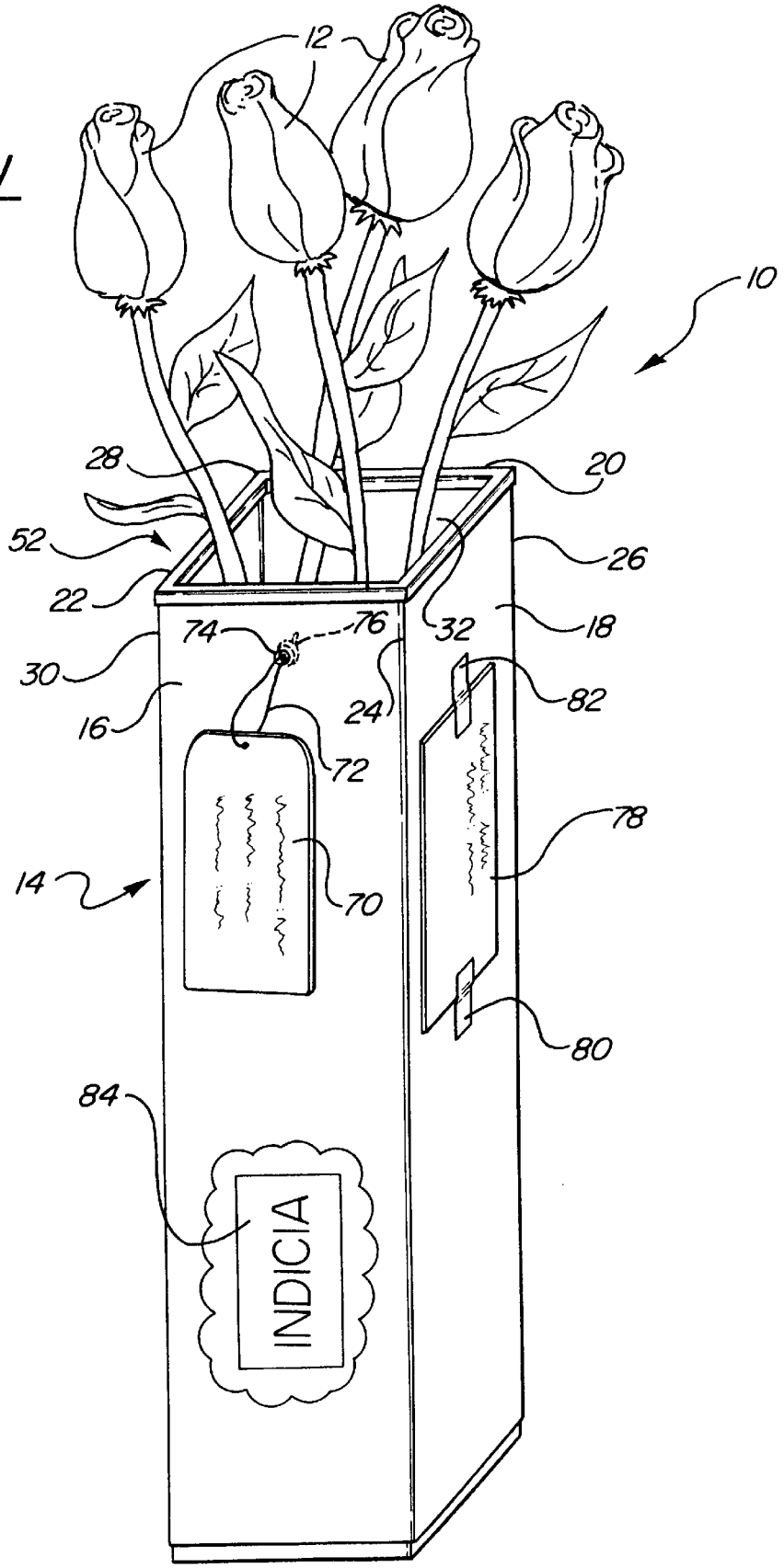
FIG. 1 is an environmental view in perspective of the collapsible flower vase assembly according to a first preferred embodiment of the present invention.

Referring now to FIG. 1, a collapsible flower vase assembly is shown at 10 according to a first preferred embodiment of the present invention. The collapsible vase assembly 10 is capable of being conveniently transported in its collapsed position and utilized for holding a plurality of long-stemmed flowers 12 in an entrapped volume of water (not shown).

Referring again to FIGS. 1 and 2, the vase assembly includes an elongate and sleeve shaped body 14 which defines a substantially rectangular shape in cross section according to a first preferred embodiment. It is also understood that the sleeve shaped body can define any type of polygonal shape in cross section such that the body extends in a perimetrical fashion. The definition of a polygon for purposes of the present invention is any number of sides ranging from three so as to form a triangle to an infinite number of sides so as to form a circle. The sleeve shaped body 14 includes a first face 16, a second face 18, a third face 20 and a fourth face 22. The faces 16, 18, 20 and 22 are all interconnected and defined therebetween is a first flexible fold line 24 (separating faces 16 and 18), a second flexible fold line 26 (separating faces 18 and 20), a third flexible fold line 28 (separating faces 20 and 22) and a fourth flexible fold line 30 (separating faces 22 and 16). The fold lines extend the longitudinal length of the elongate sleeve body 14 and permit the body 14 to be rotated from a folded position (as shown in FIG. 5) in which the sleeve shaped body 14 forms a substantially two-dimensional blank to the three dimensional and unfolded position as substantially illustrated in FIG. 1.

Figures 2, 3, 4, 5, 6:
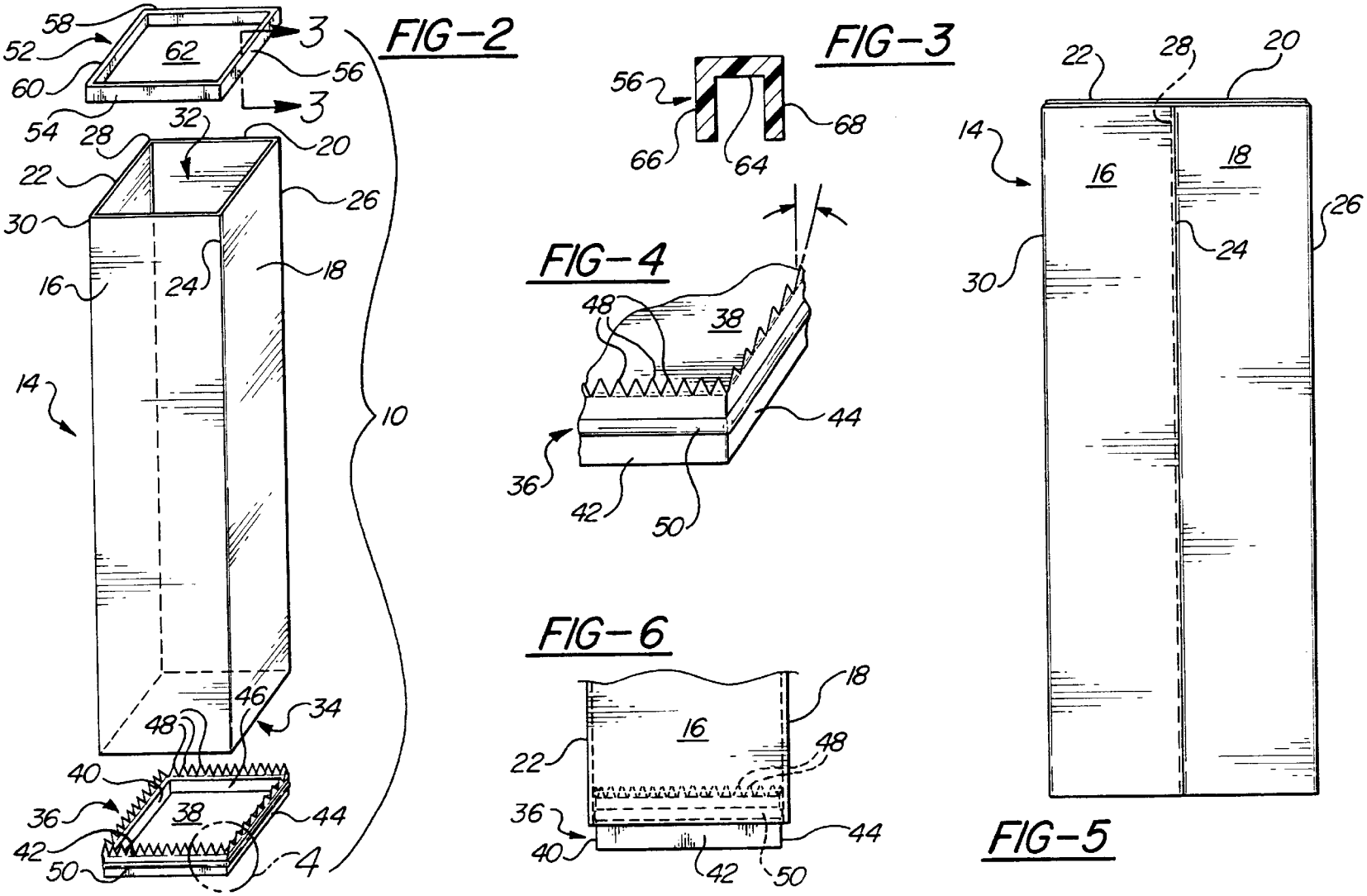
FIG. 2 is an exploded view of the collapsible flower vase assembly according to the first preferred embodiment illustrated in FIG. 1 and according to the present invention.
FIG. 3 is a cutaway view taken along line 3—3 of FIG. 2 and illustrating the substantially "U" shaped configuration of the stiffening collar portion as viewed in cross section and for engaging upon the upper facing rim of the first open end of the sleeve shaped body.
FIG. 4 is an enlarged view in section of the area defined as 4—4 in FIG. 2 and further illustrating plurality of outwardly angled and upwardly extending teeth and the outwardly projecting bead portion of the cork attachment and which facilitates the biasing and water tight engagement with the sleeve shaped body.
FIG. 5 is a frontal view of the first preferred embodiment and illustrating the one piece sleeve shaped body in a first folded position along its designated fold lines.
FIG. 6 is a sectional view of the lower end of the vase assembly according to the first preferred embodiment and illustrating in phantom the sealing engagement of the cork attachment to the sleeve shaped body according to the present invention.

The rectangular sleeve shaped body 14 is internally hollowed and includes a first open end 32 and a second open end 34 (see again FIG. 2). The elongate sleeve shaped body 14 is further constructed of a flexible and waterproof material such as a paper-based substrate coated with a water proof and plasticized material.

A cork attachment 36, see FIGS. 1, 2, 4 and 6, is provided and corresponds substantially in shape to the rectangular cross section shape of the elongate sleeve shaped body 14. The cork attachment 36 includes a central planar shaped portion 38 and first 40, second 42, third 44 and fourth 46 upwardly extending and interconnected sides. The cork attachment 36 is preferably constructed of a durable and waterproof plasticized material and is shaped such that outwardly facing surfaces of the upwardly extending and interconnected sides 46, 40, 42 and 44 biasingly engages against corresponding inwardly facing surfaces of the faces 16, 18, 20 and 22 of the sleeve shaped body 14 at the second open end 34.

A primary objective of the present invention is to achieve a secure and watertight engagement between the cork attachment and the lower open end 34 of the sleeve shaped body 14, this being a significant improvement over the prior art. This objective is accomplished in part through the provision a plurality of outwardly angled and upwardly extending teeth 48 (as is best shown in the enlarged sectional view of FIG. 4) extending in aligned and perimetrical fashion from the upwardly extending and interconnected sides 40, 42, 44 and 46 of the cork attachment 36 and engaging against the inwardly facing surfaces of the sleeve shaped body 14 proximate the second and lower open end 34. According to the preferred embodiment, the teeth 48 are bevelled in shape and extend outwardly in a generally 20 to 60 degree fashion from a vertical axis extending through a selected and interconnected side 40, 42, 44 or 46.

Employed in cooperating fashion with the teeth 48 is an outwardly projecting bead portion 50 which extends in a generally horizontal and centralized fashion from the outwardly facing surfaces of the interconnected sides 40, 42, 44 and 46 of the cork attachment 36. The bead portion 50 is constructed of a slightly deformable and biasing rubberized or plasticized material and is capable of being resiliently engaged against the inwardly facing surfaces of the sides of the elongate sleeve shaped body 14 proximate the second and lower open end 34 such that, upon filling the interior of the sleeve shaped body 14 with water, the engagement of the cork attachment 36 against the lower end of the sleeve shaped body is watertight and will not result in leakage in use.

A further element utilized with the flower vase assembly 10 according to the first preferred embodiment is a stiffening collar portion 52 which, similarly to the cork attachment 36, is constructed of a durable plasticized material and is substantially rectangular shaped in cross section having a first side 54, a second interconnected side 56, a third interconnected side 58 and a fourth interconnected side 60. A central open area 62 is defined between the interconnected sides 54, 56, 58 and 60 and the stiffening collar portion 52 is configured so that it engages over a rim defining a top edge of the first open end 32 of the sleeve shaped body 14. Specifically, and referring further to FIG. 3, an enlarged and cutaway view of side 56 of the stiffening collar portion 52 is shown and illustrates a substantially downwardly facing and "U" shape defined by a central horizontal portion 64 terminating at one end in a first downwardly extending leg 66 and at an opposite end in a second downwardly extending leg 68. The downward "U" shaped configuration of the stiffening collar portion 52 results in a sufficient open central area of the collar portion for being releasably and affixably secured over the top rim defined at the first open end 32 so that the downwardly extending legs 66 and 68 biasingly engage against the inner and outer faces of the body 14 at the open upper end 32 and so that elongate and sleeve shaped body 14 is retained at its upper end in its unfolded and three dimensional position in combination with the same function provided at the lower and second open end 34 by the secured cork attachment 36.

Referring again to FIG. 1, a greeting card may be attached to the elongate and sleeve shaped body 14 in one of a number of different fashions and so that the collapsible vase assembly 10 of the present invention may be employed with a suitable greeting and thereby be employed as part of a floral delivery also including flowers. In one preferred variant, a greeting card is shown at 70 and is secured to the collapsible vase through a cord 72, one end of which is secured to the card 70 by a suitable adhesive. The cord 72 extends through an aperture 74 formed within the surface of the body 14, such as within side 16 proximate the upper end as illustrated in FIG. 1 and so as not to interfere with the ability to fill the interior of the body with water to a sufficient height. The other end of the cord 72 is knotted at 76 so that the knot is larger than the diameter of the aperture 74 and so as to be retained within an interior of the body 14.

In a further preferred variant, a greeting card 78 is held in place against a selected surface of the elongate body 14, such as through the use of adhesive strips 80 and 82. In further embodiments, written indicia 84 may be placed directly on a selected surface of the elongate body 14 (such as along side 18 in FIG. 1) and may function in addition or in lieu of a suitable greeting card.

Figure 7:
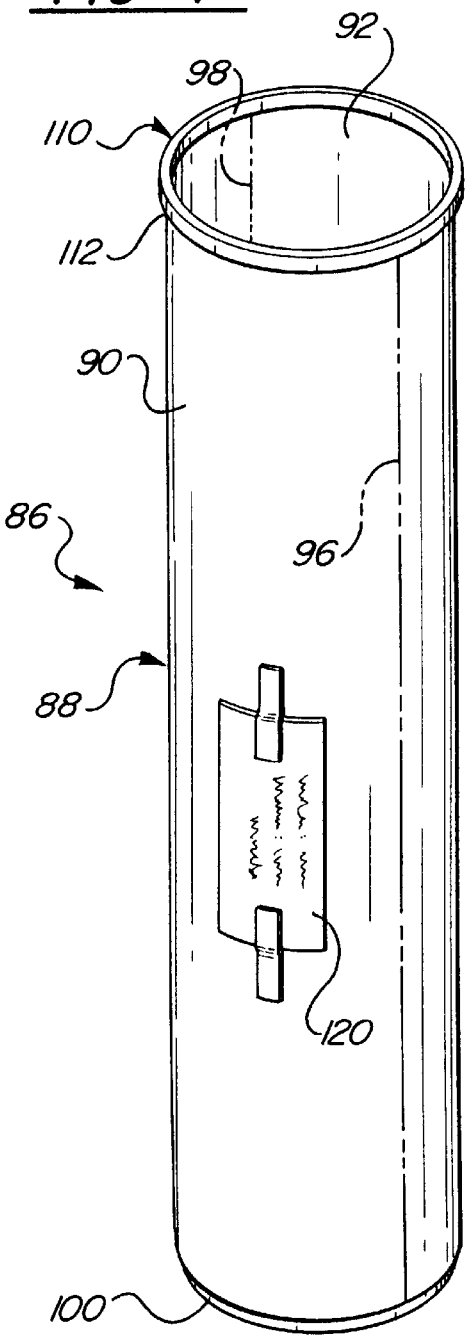
FIG. 7 is a perspective view of the collapsible flower vase assembly according to a further preferred embodiment of the present invention.
Figure 13:
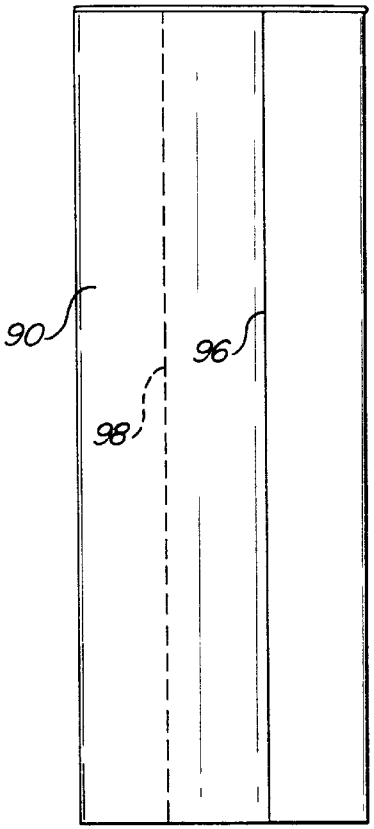
FIG. 13 is a frontal view of the second preferred embodiment and illustrating the one piece sleeve shaped body in a first folded position along its designated fold lines.

Referring now to FIG. 7, a collapsible flower vase assembly is illustrated at 86 according to a further preferred embodiment of the present invention and includes an elongate and sleeve shaped body 88 defining a substantially circular shape in cross section. The circular shaped body 88 is defined by one continuous side wall 90 which is constructed of a similar flexible and waterproof material as described in reference to the first preferred embodiment and further includes a first upper and open end 92 and a second lower and open end 94 (see also FIG. 9) as well as a first longitudinally extending fold line 96 and a second circumferentially spaced apart and longitudinally extending fold line 98 so that the elongate sleeve body is cylindrical in shape and is outwardly expandable from a fist folded and substantially two-dimensional position (see FIG. 13) to a second unfolded and substantially three-dimensional position (see again FIGS. 7 and 9) in which it is capable of being employed in the same fashion as in the first preferred embodiment 10 previously described in reference to FIG. 1.

Figure 11:
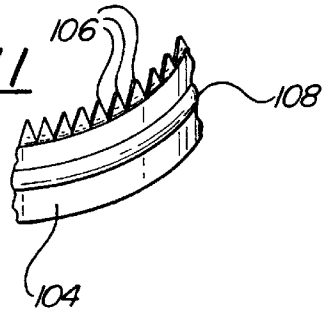
FIG. 11 is an enlarged view in cross section of the area defined as 11—11 in FIG. 9 and again illustrating the plurality of outwardly angled and upwardly extending teeth and the outwardly projecting bead portion of the cork attachment which facilitates the biasing and water tight engagement with the sleeve shaped body.
Figure 12:
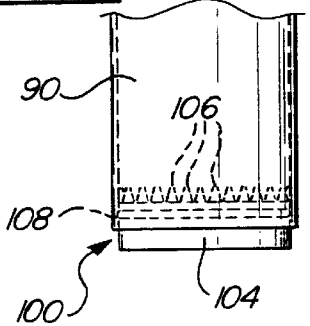
FIG. 12 is a sectional view of the lower end of the vase assembly according to the second preferred embodiment and illustrating in phantom the sealing engagement of the cork attachment to the sleeve shaped body according to the present invention.
Figure 9:
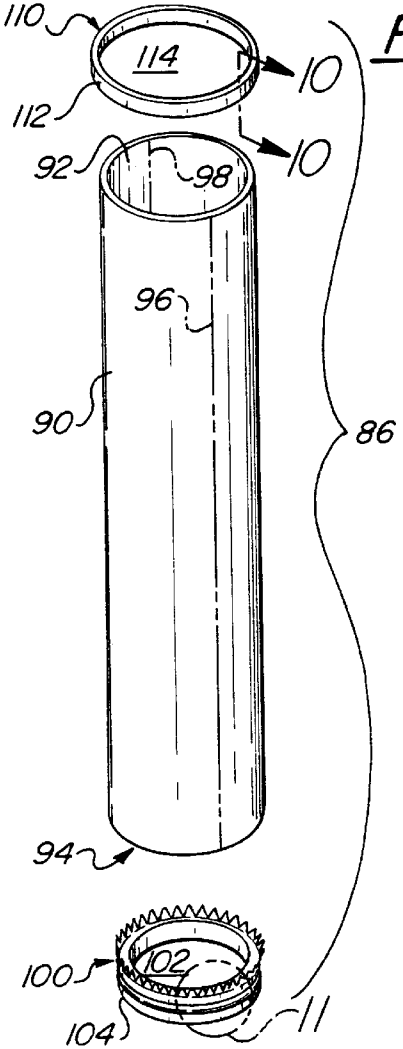
FIG. 9 is an exploded view of the collapsible flower vase assembly as illustrated in FIG. 7 and according to the further preferred embodiment of the present invention.

Referring further to FIGS. 9 and 12, the collapsible vase assembly 86 of the second preferred embodiment similarly includes a cork attachment 100 also constructed of a durable and plasticized material and including a central planar shaped area 102 and a circumferentially and upwardly extending side wall 104 substantially matching in configuration the lower and second open end 94 of the circular sleeve shaped body 88. Referring further to the enlarged sectional view of FIG. 11, the cork attachment 100 again includes the plurality of outwardly angled and upwardly extending teeth 106 and the circumferentially extending and outwardly projecting bead portion 108 which function in cooperation to provide a secure and watertight sealing engagement between the outwardly facing surface of the side wall 104 of the cork attachment and the corresponding inwardly facing surface of the continuous side wall 90 of the elongate sleeve shaped body 88, this being identical in description to the function provided by the corresponding elements in the first preferred embodiment.

Figure 10:
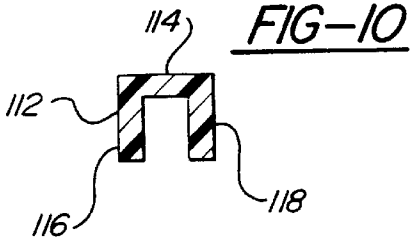
FIG. 10 is a cutaway taken along line 10—10 of FIG. 9 and again illustrating the substantially "U" shape of the stiffening collar portion as viewed in cross section and according to the present invention.

Also, referring to FIG. 9, a stiffening collar portion 110 is illustrated which secures over a rim defined by an upper edge of the first open end 92 of the sleeve shaped body 88. Again, the stiffening collar portion 110 includes a continuous side wall 112 which defines an open interior. Referring to the cutaway of FIG. 10, the collar portion 110 similarly includes a substantially "U" shape in cross section in which a central horizontal portion 114 terminates at opposite ends in first 116 and second 118 downwardly extending legs for engaging the inward and outward faces of the continuous side wall 90 of the elongate body 88 concurrent with the cork attachment 100 being secured at the lower and second open end 94.

Figure 8:
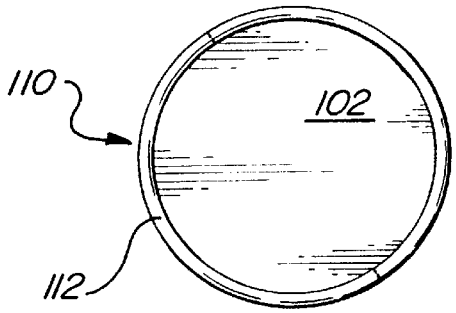
FIG. 8 is top view of the collapsible flower vase assembly and illustrating the stiffening collar insert portion in place over a top rim defined upon the first open end of the sleeve shaped body according to the present invention.

Referring finally to FIG. 8, a top view of the assembled collapsible flower vase assembly is shown in two dimension and illustrates the stiffening collar portion 110 at the top end and the central open area 102 of the cork attachment 100 which defines the enclosed bottom of the vase assembly. Further, as with the first preferred embodiment, the elongate sleeve body of the vase assembly may be delivered in its initially collapsed position (FIG. 13) and assembled with the cork attachment 100 and stiffening collar portion 110 to its use position (FIG. 9) whereupon a volume of water (again not shown) fills the open interior of the vase and long-stemmed flowers are inserted (such as illustrated in the embodiment of FIG. 1). A suitable greeting card is also employed with the collapsible vase assembly of the second preferred embodiment, such as is shown at 120 in FIG. 7, and further in any fashion illustrated in the first preferred embodiment.

Having described my invention, further embodiments will become apparent to those skilled in the art to which it pertains without deviating from the scope of the appended claims.

I claim:

1. A collapsible flower vase assembly for use in holding and preserving a plurality of long-stemmed flowers in an entrapped volume of water, said flower vase assembly comprising:

an elongate and sleeve shaped body defining a rectangular shape in cross section, said sleeve shaped body including first, second third and fourth fold lines located at interconnecting edges established between succeeding faces of said rectangular shape, said fold lines extending along a longitudinal length of said elongate sleeve, said sleeve shaped body including a first open end and a second open end and being constructed of a flexible and water proof material;

a stiffening collar portion engageable to said first open end;

a cork attachment corresponding substantially in shape to said rectangular cross sectional shape of said sleeve shaped body;

attachment means for releasably securing said cork attachment to said second open end of said sleeve shaped body in a fluid tight manner and so that said cork attachment provides a pedestal base support for arraying said sleeve shaped body in an upwardly extending fashion from a level surface; and a greeting card and attachment means for securing said greeting card to a selected location along said sleeve shaped body;

said elongate and sleeve shaped body being being outwardly expanded from a first folded to a second unfolded position prior to said cork attachment being releasably secured to said second open end.

2. A collapsible flower vase assembly for use in holding and preserving a plurality of long-stemmed flowers in an entrapped volume of water, said flower vase assembly comprising:

an elongate and sleeve shaped body defining a circular shape in cross section, said sleeve shaped body including a first fold line and a second fold line at spaced apart locations and extending along a longitudinal length of said elongate sleeve, said sleeve shaped body including a first open end and a second open end and being constructed of a flexible and water proof material;

a stiffening portion engageable to said first open end;

a cork attachment corresponding substantially in shape to said circular cross sectional shape of said sleeve shaped body;

attachment means for releasably securing said cork attachment to said second open end of said sleeve shaped body in a fluid tight manner and so that said cork attachment provides a pedestal base support for arraying said sleeve shaped body in an upwardly extending fashion from a level surface; and a greeting card and attachment means for securing said greeting card to a selected location along said sleeve shaped body;

said elongate and sleeve shaped body being being outwardly expanded from a first folded to a second unfolded position prior to said cork attachment being releasably secured to said second open end.

3. A collapsible flower vase assembly for use in holding and preserving a plurality of long-stemmed flowers in an entrapped volume of water, said flower vase assembly comprising:

an elongate and sleeve shaped body defining a polygonal shape in cross section, said sleeve shaped body including at least first and second fold lines extending along a longitudinal length of said elongate sleeve, said sleeve shaped body including a first open end and a second open end and being constructed of a flexible and water proof material;

a stiffening collar portion engageable to said first open end;

a cork attachment corresponding substantially in shape to said polygonal cross sectional shape of said sleeve shaped body; and attachment means for releasably securing said cork attachment to said second open end of said sleeve shaped body in a fluid tight manner and so that said cork attachment provides a pedestal base support for arraying said sleeve shaped body in an upwardly extending fashion from a level surface;

said elongate and sleeve shaped body being outwardly expanded from a first folded to a second unfolded position prior to said cork attachment being releasably secured to said second open end.

4. The collapsible flower vase assembly according to claim 3, wherein said elongate and sleeve shaped body further comprises a paper-based substrate coated with a water proof and plasticized material.

5. The collapsible flower vase assembly according to claim 3, wherein said elongate and sleeve shaped body is rectangular shaped in cross section.

6. The collapsible flower vase assembly according to claim 3, wherein said elongate and sleeve shaped body is circular shaped in cross section.

7. The collapsible flower vase assembly according to claim 3, further comprising a written indicia placed upon an exterior facing surface of said elongate and sleeve shaped body.

8. The collapsible flower vase assembly according to claim 3, further comprising an aperture being formed in said sleeve shaped body at a selected location, a length of cord being engaged to said sleeve shaped body at a knotted end extending through said aperture, a greeting card secured to an end of said cord opposite said knotted end.

9. The collapsible flower vase assembly according to claim 3, wherein the stiffening collar portion polygonal shaped in cross section and substantially corresponding to said first open end of said elongate and sleeve shaped body, said collar portion being engaged over a rim defining a top edge of said first open end.

10. The collapsible flower vase assembly according to claim 9, said stiffening collar portion further comprising in cross section a substantially "U" shaped configuration.

11. The collapsible flower vase assembly according to claim 3, said cork attachment further comprising a central planar shaped portion and a plurality of upwardly extending and interconnected sides.

12. The collapsible flower vase assembly according to claim 11, said attachment means further comprising outwardly facing surfaces of said plurality of upwardly extending and interconnected sides biasingly engaging against correspondingly inwardly facing surfaces of said sleeve shaped body at said second end.

13. The collapsible flower vase assembly according to claim 12, further comprising a plurality of outwardly angled and upwardly extending teeth extending in aligned and perimetrical fashion from said plurality of upwardly extending and interconnected sides of said cork attachment and engaging against said inwardly facing surfaces of said sleeve shaped body.

14. The collapsible flower vase assembly according to claim 12, further comprising an outwardly projecting bead portion extending from said outwardly facing surfaces of said interconnected sides of said cork attachment and in an encircling fashion so as to define a perimeter around said cork attachment, said bead portion sealingly engaging against said inwardly facing surfaces of said sleeve shaped body.

* * * * *